US007610766B2

(12) United States Patent
Dubé

(10) Patent No.: US 7,610,766 B2
(45) Date of Patent: Nov. 3, 2009

(54) HIGH-SPEED DEFROST REFRIGERATION SYSTEM

(76) Inventor: Serge Dubé, 1341 Principale, St-Zotique, Québec (CA) J0P 1Z0

( * ) Notice: Subject to any disclaimer, the term of this patent is extended or adjusted under 35 U.S.C. 154(b) by 596 days.

(21) Appl. No.: 11/056,117

(22) Filed: Feb. 14, 2005

(65) Prior Publication Data

US 2005/0138936 A1 Jun. 30, 2005

Related U.S. Application Data

(60) Continuation-in-part of application No. 10/863,495, filed on Jun. 9, 2004, now Pat. No. 6,983,613, which is a division of application No. 10/189,462, filed on Jul. 8, 2002, now Pat. No. 6,775,993.

(51) Int. Cl.
*F25D 21/06* (2006.01)
*F25B 49/00* (2006.01)

(52) U.S. Cl. ..... 62/151; 62/81; 62/196.1; 62/197

(58) Field of Classification Search ..... 62/80, 62/81, 510, 196.1, 196.2, 196.4, 151, 152, 62/197

See application file for complete search history.

(56) References Cited

U.S. PATENT DOCUMENTS

| | | | | |
|---|---|---|---|---|
| 2,978,877 A | | 4/1961 | Long | |
| 3,332,251 A | | 7/1967 | Watkins | |
| 3,645,109 A | * | 2/1972 | Quick | 62/196.2 |
| 4,167,102 A | | 9/1979 | Willitts | |
| 4,589,263 A | * | 5/1986 | DiCarlo et al. | 62/193 |
| 4,979,371 A | | 12/1990 | Larson | |
| 5,319,940 A | | 6/1994 | Yakaski | |
| 5,673,567 A | * | 10/1997 | Dube | 62/117 |
| 5,887,440 A | | 3/1999 | Dubé | |
| 6,089,033 A | * | 7/2000 | Dube | 62/156 |
| 6,170,272 B1 | * | 1/2001 | Backman | 62/117 |
| 6,807,813 B1 | * | 10/2004 | Lesage | 62/81 |
| 2006/0130494 A1 | * | 6/2006 | Dube | 62/81 |

* cited by examiner

*Primary Examiner*—Marc E Norman
(74) *Attorney, Agent, or Firm*—Ogilvy Renault LLP

(57) ABSTRACT

A defrost refrigeration system of the type having a main refrigeration circuit operating a refrigeration cycle. The defrost refrigeration system comprises a first line extending from the first compressor to the evaporator stage and is adapted to receive a portion of discharged low-pressure refrigerant from the first compressor. Valves are provided for stopping a suction of cooling refrigerant in an evaporator of the evaporator stage and for directing a flow of defrost refrigerant to release heat to defrost the evaporator. A second line is provided for directing the refrigerant having released heat to the expansion stage of the refrigeration cycle. A pressure reducing device is optionally positioned downstream of the condensing stage for adjusting a pressure of the refrigerant in the high-pressure liquid state mixing with the defrost refrigerant having released heat.

14 Claims, 6 Drawing Sheets

HIGH-SPEED DEFROST REFRIGERATION SYSTEM

CROSS-REFERENCE TO RELATED APPLICATION

This patent application is a continuation-in-part of U.S. patent application Ser. No. 10/863,495, filed on Jun. 9, 2004, now U.S. Pat. No. 6,983,613 by the present Applicant, which is a divisional of U.S. patent application Ser. No. 10/189,462, filed on Jul. 8, 2002, now U.S. Pat. No. 6,775,993.

TECHNICAL FIELD

The present invention relates to a high-speed evaporator defrost system for defrosting refrigeration coils of evaporators in a short period of time without having to increase compressor head pressure.

BACKGROUND ART

In refrigeration systems found in the food industry to refrigerate fresh and frozen foods, it is necessary to defrost the refrigeration coils of the evaporators periodically, as the refrigeration systems working below the freezing point of water are gradually covered by a layer of frost which reduces the efficiency of evaporators. The evaporators become clogged up by the build-up of ice thereon during the refrigeration cycle, whereby the passage of air maintaining the foodstuff refrigerated is obstructed. Exposing foodstuff to warm temperatures during long defrost cycles may have adverse effects on their freshness and quality.

One method known in the prior art for defrosting refrigeration coils uses an air defrost method wherein fans blow warm air against the clogged-up refrigeration coils while refrigerant supply is momentarily stopped from circulating through the coils. The resulting defrost cycles may last up to about 40 minutes, thereby possibly fouling the foodstuff.

In another known method, gas is taken from the top of the reservoir of refrigerant at a temperature ranging from 80° F. to 90° F. and is passed through the refrigeration coils, whereby the latent heat of the gas is used to defrost the refrigeration coils. This also results in a fairly lengthy defrost cycle.

U.S. Pat. No. 5,673,567, issued on Oct. 7, 1997 to the present inventor, discloses a system wherein hot gas from the compressor discharge line is fed to the refrigerant coil by a valve circuit and back into the liquid manifold to mix with the refrigerant liquid. This method of defrost usually takes about 12 minutes for defrosting evaporators associated with open display cases and about 22 minutes for defrosting frozen food enclosures. The compressors are affected by hot gas coming back through the suction header, thereby causing the compressors to overheat. Furthermore, the energy costs increases with the compressor head pressure increase.

U.S. Pat. No. 6,089,033, published on Jul. 18, 2000 to the present inventor, introduces an evaporator defrost system operating at high speed (e.g., 1 to 2 minutes for refrigerated display cases, 4 to 6 minutes for frozen food enclosures) comprising a defrost conduit circuit connected to the discharge line of the compressors and back to the suction header through an auxiliary reservoir capable of storing the entire refrigerant load of the refrigeration system. The auxiliary reservoir is at low pressure and is automatically flushed into the main reservoir when liquid refrigerant accumulates to a predetermined level. The pressure difference between the low-pressure auxiliary reservoir and the typical high pressure of the discharge of the compressor creates a rapid flow of hot gas through the evaporator coils, thereby ensuring a quick defrost of the refrigeration coils. Furthermore, the suction header is fed with low-pressure gas to prevent the adverse effects of hot gas and high head pressure on the compressors.

SUMMARY OF INVENTION

It is a feature of the present invention to provide a high-speed defrost refrigeration system that operates a defrost of evaporators at low pressure.

It is a further feature of the present invention to provide a high-speed defrost refrigeration system having a compressor dedicated to defrost cycles.

It is a still further feature of the present invention to provide a high-speed defrost refrigeration system having a low-pressure defrost loop.

It is a still further feature of the present invention to provide a method for defrosting at high-speed refrigeration systems with low-pressure in the evaporators.

It is a still further feature of the present invention to provide a method for operating a high-speed defrost refrigeration system having a compressor dedicated to defrost cycles.

According to the above features, from a broad aspect, the present invention provides a defrost refrigeration system of the type having a main refrigeration circuit operating a refrigeration cycle, wherein a refrigerant goes through at least a compressing stage having at least a first and a second compressor, wherein said refrigerant is compressed to a high-pressure gas state to then reach a condensing stage, wherein said refrigerant in said high-pressure gas state is condensed at least partially to a high-pressure liquid state to then reach an expansion stage, wherein said refrigerant in said high-pressure liquid state is expanded to a first low-pressure liquid state to then reach an evaporator stage, wherein said refrigerant in said first low-pressure liquid state is evaporated at least partially to a first low-pressure gas state by absorbing heat, to then return to said compressing stage, said defrost refrigeration system comprising a first line extending from said first compressor to the evaporator stage and adapted to receive at least a portion of discharged refrigerant from said first compressor, a valve for stopping a suction by the compressing stage of said refrigerant in said first low-pressure liquid state in at least one evaporator of the evaporator stage and directing a flow of said discharged refrigerant to release heat to defrost the at least one evaporator and thereby changing phase at least partially to a second low-pressure liquid state, a second line for directing said refrigerant having released heat to the expansion stage of the refrigeration cycle, and a pressure reducing device downstream of the condensing stage for adjusting a pressure of the refrigerant in the high-pressure liquid state mixing with said refrigerant having released heat.

Further in accordance with the present invention, there is provided a method for defrosting evaporators in a refrigeration system of the type having a cooling refrigerant circulating sequentially between a compression stage, a condensing stage, an expansion stage and an evaporation stage to then return to the compression stage, comprising the steps of: i) stopping a suction of the cooling refrigerant in a first evaporator of the evaporation stage; ii) directing defrost refrigerant from the compression stage to the first evaporator so as to defrost the first evaporator; iii) directing the defrost refrigerant from the first evaporator upstream of the expansion stage; and iv) mixing the cooling refrigerant from the condensing stage with the defrost refrigerant by controlling a cooling refrigerant pressure downstream of the condensing stage; whereby a second evaporator of the evaporation stage is cooled with the mixture of cooling refrigerant from the condensing stage with the defrost refrigerant.

Still further in accordance with the present invention, there is provided a method for installing a defrost system in a refrigeration system of the type having a cooling refrigerant circulating sequentially between a compression stage, a condensing stage, an expansion stage and an evaporation stage to then return to the compression stage, comprising the steps of providing a valve to stop a suction of cooling refrigerant in at least a first evaporator of the evaporation stage, positioning a first line feeding the first evaporator with cooling refrigerant from the compression stage, positioning a second line between the first evaporator and a main line between the condensing stage and the expansion stage to direct the defrost refrigerant from the first evaporator to the main line, and providing a pressure reducing device in the main line to reduce the pressure of the cooling refrigerant for a subsequent mixing with the defrost refrigerant from the second line.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
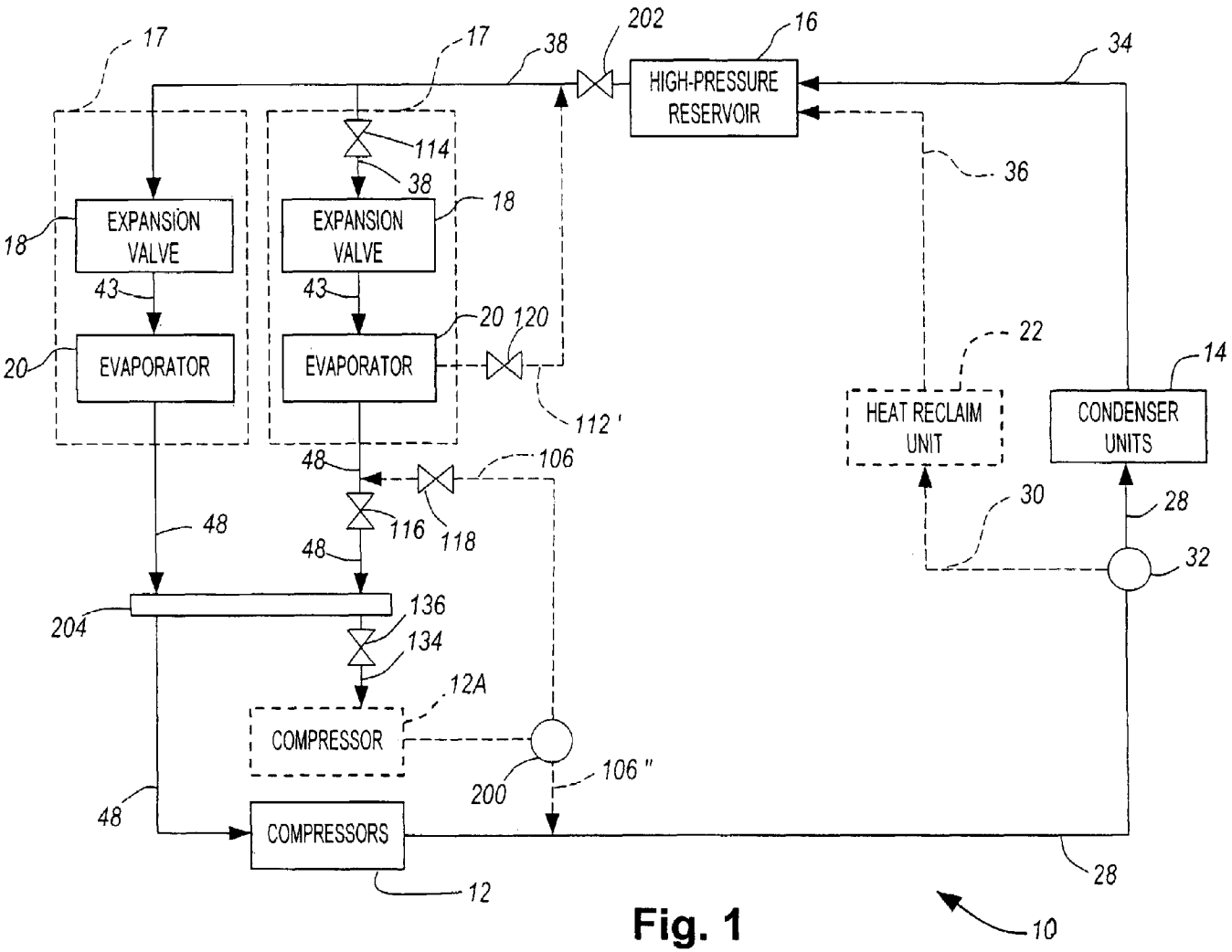
FIG. 1 is a block diagram showing a simplified refrigeration system constructed in accordance with a first embodiment of the present invention.

Referring to the drawings, and more particularly to FIG. 1, a refrigeration system in accordance with a first embodiment of the present invention is generally shown at 10. The refrigeration system 10 comprises the components found on typical refrigeration systems in which circulates a cooling refrigerant, at different states and pressures according to the stage of the refrigeration cycle, such as compressors 12 (one of which is 12A, for reasons to be described hereinafter), a high-pressure reservoir 16, expansion valves 18, and evaporators 20. The refrigeration system 10 is shown having a heat reclaim unit 22, which is optional. In FIG. 1, the refrigeration system 10 is shown having only two sets of evaporator 20/expansion valve 18 for the simplicity of the illustration. It is obvious that numerous other sets of evaporator 20/expansion valve 18 may be added to the refrigeration system 10.

The compressors 12 are connected to the condenser units 14 by lines 28. High-pressure gas refrigerant is discharged from the compressors 12 and flows to the condenser units 14 through the line 28. A line 30 diverges from the line 28 by way of three-way valve 32. The line 30 extends between the three-way valve 32 and the heat reclaim unit 22. A line 34 connects the condenser units 14 to the high-pressure reservoir 16, and a line 36 links the heat reclaim unit 22 to the high-pressure reservoir 16. The condenser units 14 are typically rooftop condensers that are used to release energy of the high-pressure gas refrigerant discharged by the compressors 12 by a change to the liquid phase. Accordingly, refrigerant accumulates in the high-pressure reservoir 16 in a liquid state.

Evaporator units 17 are connected between the high-pressure reservoir 16 and the compressors 12/12A. Each of the evaporator units 17 has an evaporator 20 and an expansion valve 18. The expansion valves 18 are connected to the high-pressure reservoir 16 by line 38. As known in the art, the expansion valves 18 create a pressure differential so as to control the pressure of saturated liquid/gas refrigerant sent to the evaporators 20. The outlet of the evaporators 20 are connected to the compressors 12 by lines 48. The compressors 12 are supplied with low-pressure gas refrigerant via supply lines 48. The expansion valves 18 control the pressure of the cooling refrigerant that is sent to the evaporators 20, such that the cooling refrigerant changes phases in the evaporators 20 by a fluid, such as air, blown across the evaporators 20 to reach refrigerated display counters (e.g., refrigerators, freezers or the like) at low refrigerating temperatures.

Refrigerant in the refrigeration system 10 is in a high-pressure gas state when discharged from the compressors 12. For instance, a typical head pressure of the compressors is 200 Psi. The compressor head pressure changes as a function of the outdoor temperature to which the refrigerant in the condensing stage will be subjected. The high-pressure gas refrigerant is conveyed to the condenser units 14 and, if applicable, to the heat reclaim unit 22 via the line 28 and the line 30, respectively.

In the condenser units 14 and the heat reclaim unit 22, the refrigerant releases heat so as to go from the gas state to a liquid state, with the pressure remaining generally the same. Accordingly, the high-pressure reservoir 16 accumulates high-pressure liquid refrigerant that flows thereto by the lines 34 and 36, as previously described.

The compressors 12 exert a suction on the evaporators 20 through the supply lines 48. The expansion valves 18 control the pressure in the evaporators 20 as a function of the suction by the compressors 12. Accordingly, high-pressure liquid refrigerant accumulates in the line 38 to thereafter exit through the expansion valves 18 to reach the evaporators 20 via the lines 43 in a low-pressure saturated liquid/gas state. During a refrigeration cycle, the refrigerant absorbs heat in the evaporators 20, so as to change state to become a low-pressure gas refrigerant. Finally, the low-pressure gas refrigerant flows through the line 48 so as to be compressed once more by the compressors 12 to complete the refrigeration cycle.

As frost and ice build-up are frequent on the evaporators, the evaporators 20 are provided with a defrost system for melting the frost and ice build-up. Only one of the evaporator units 17 is shown having defrost equipment, for simplicity of the drawings, but all evaporator units 17 can be provided with defrost equipment.

Valves are provided in the evaporator units 17 so as to control the flow of refrigerant in the evaporators 20. A valve 114 is typically provided in the line 38. The valve 114 is normally open, but is closed during defrosting of its evaporator unit 17. A valve 116 is positioned on the line 48 and is normally open. The line 106 merges with the line 48 between the valve 116 and the evaporator 20. The line 106 has a valve 118 therein.

In a normal refrigeration cycle, refrigerant flows in the line 38 through the valve 114, to reach the expansion valves 18. A pressure drop in refrigerant is caused at the expansion valve 18. The resulting low-pressure liquid refrigerant reaches the evaporators 20, wherein it will absorb heat to change state to gas. Thereafter, refrigerant flows through the low-pressure gas refrigerant line 48 and the valve 116 therein to the compressors 12.

During a defrost cycle of an evaporator 20, valves 118 and 120 are open, whereas the valves 114 and 116 are closed. Accordingly, the expansion valve 18 and the evaporator 20 will not be supplied with low-pressure liquid refrigerant from the line 38, as it is closed by valve 114.

The dedicated compressor 12A collects low-pressure gas refrigerant from a suction header 204 that also supplies the other compressors 12 in refrigerant. However, the compressor 12A is the only compressor supplying evaporators in defrost cycles, whereby its discharge pressure can be lowered. This is performed by having line 106 connected to the evaporators 20 by valve 116 closing to direct refrigerant via line 48 thereto (shown connected to only one line 48 in FIG. 1 but connected to all lines 48 of all evaporators 20 requiring defrost). A portion of the refrigerant discharged by the compressor 12A can be sent to the condensing stage, via line 106 that converges with the line 28. A valve 200 (e.g., a three-way modulating valve), controls the portions of refrigerant discharge going to the lines 106 and 106".

Figure 2:
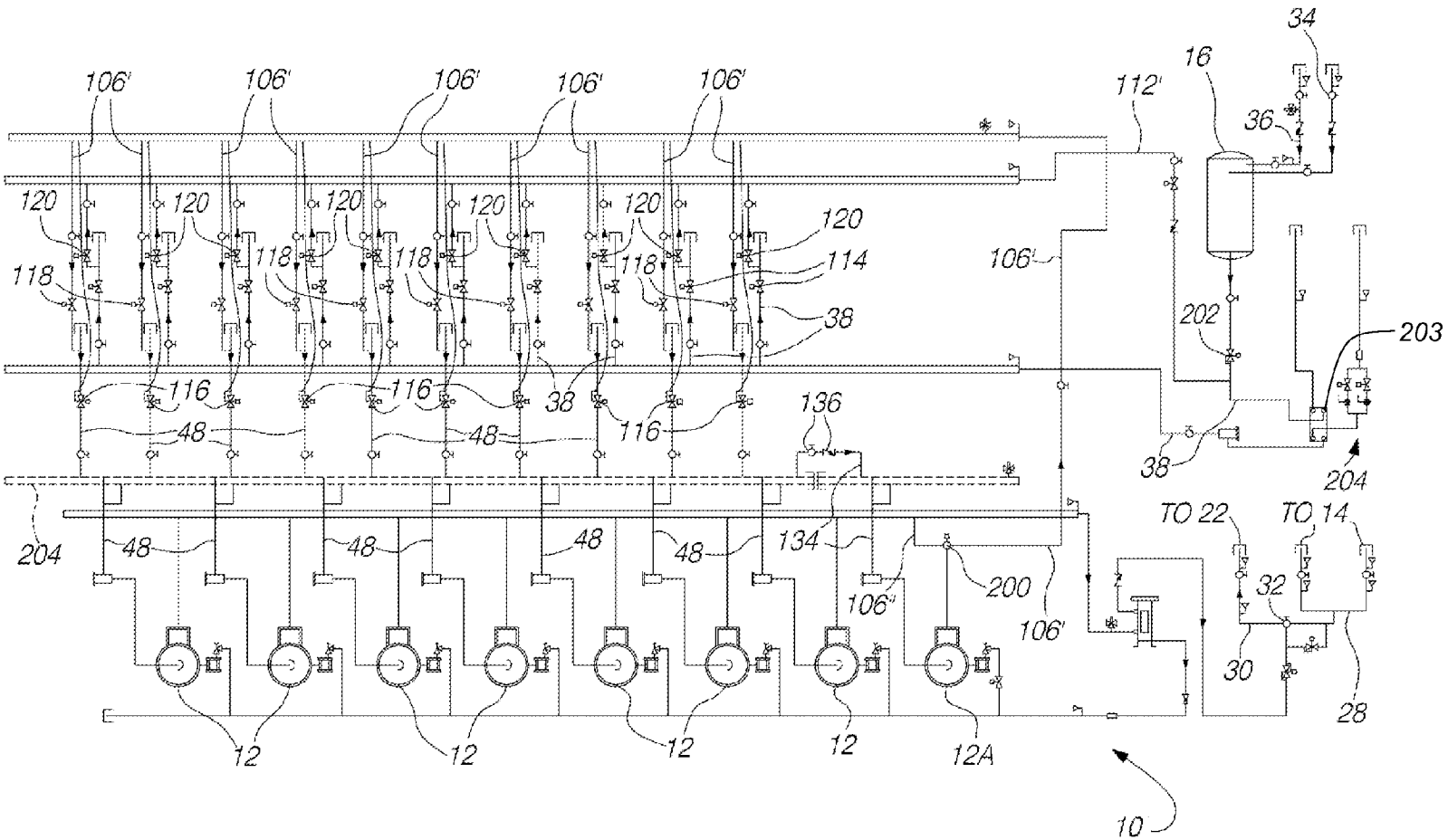
FIG. 2 is a schematic view showing the refrigeration system of FIG. 1.

Thereafter, the refrigerant exiting from the defrosted evaporators 20 is injected into the evaporators 20 in a refrigeration cycle. Line 112' collects liquid refrigerant exiting from the evaporators 20 in defrost, and converges with the line 38 upstream of the expansion valves 18, such that the liquid refrigerant can be injected in the evaporators 20 in the refrigeration cycle. A valve 202 (e.g., pressure regulating valve) ensures that a proper refrigerant pressure is provided to the line 38, and compensates a lack of refrigerant pressure by transferring liquid refrigerant from the high-pressure reservoir 16 to the line 38. The combination of the dedicated compressor 12A (i.e., low-pressure refrigerant feed to the defrost evaporators, also achievable by a pressure regulator, as described for the refrigeration system of FIG. 1 of U.S. Pat. No. 6,775,993) and the valve 202 enable the injection of low-pressure refrigerant, which exits from the defrost cycle, in the evaporator units 17. Previously, reinjected defrost refrigerant had to be conveyed to the condensing stage to reach adequate conditions to be reinjected into the evaporation cycles. As shown in FIG. 2, heat exchanger 203 is provided downstream of the valve 202 so as to remove excess gas defrost refrigerant.

As seen in FIG. 2, a subcooling system 204 can be used to ensure the proper state of the refrigerant reaching the evaporator units 17. With the refrigeration system 10 of FIGS. 1 and 2, the defrost refrigerant can be reinjected in the evaporator units 17 at pressures as low as 120 to 140 Psi for refrigerant 22, and 140 to 160 Psi for refrigerant 507 and refrigerant 404, even though the refrigerant 22 is up to about 220 to 260 Psi in the condenser units 14, and the refrigerant 507 and the refrigerant 404 are up to about 250 to 340 Psi.

A bypass line 134 and a check valve 136 therein are connected from the line 48 to the compressor 12A. The check valve 136 enables a flow of refrigerant therethrough such that the inlet pressure at the compressors 12 and the dedicated compressor 12A is generally the same.

When the defrost cycle has been completed, the valves are reversed so as to return the defrosted evaporator 20 to the refrigeration cycle. More specifically, the valves 114 and 116 are opened, and the valves 118 and 120 are closed. It is preferred that the valve 116 be of the modulating type (e.g., Mueller modulating valve, www.muellerindustries.com), or a pulse valve. Accordingly, a pressure differential in the line 48 between upstream and downstream portions with respect to the valve 116 will not cause water hammer when the valve 116 is open. The pressure will gradually be decreased by the modulation of the valve 116. Furthermore, the refrigerant reaching the compressors 12 via the line 48 will remain at advantageously low pressures.

It is pointed out that line 112' and valve 120 are generically illustrated in FIG. 1 as connecting the evaporator 20 to the line 38. This may be done in various configurations, using for instance existing lines. As shown in FIGS. 6A and 6B, the line 112' and the valve 120 may consist of a pair of lines and check valves that enable defrost refrigerant to surround the expansion valve 18 and the valve 114, if applicable.

Figure 6C:
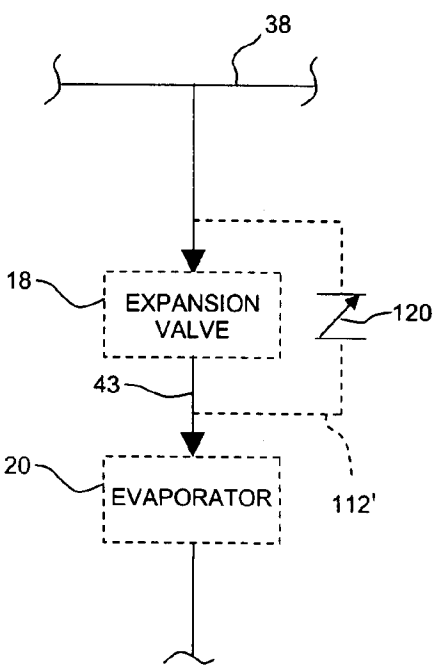
FIG. 6C is an enlarged block diagram showing a third embodiment of a line relating an evaporator in defrost to a main refrigeration line.
Figure 6B:
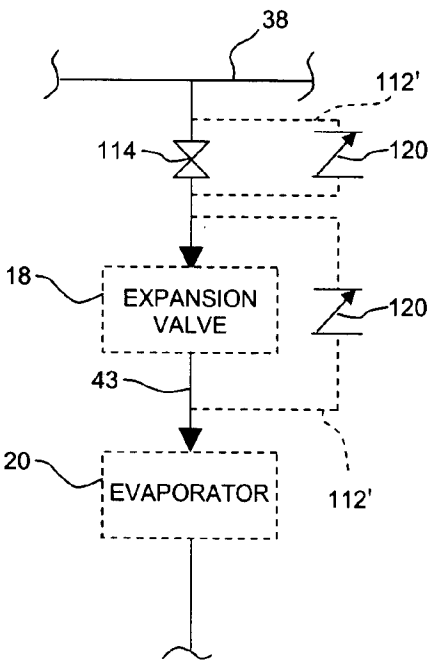
FIG. 6B is an enlarged block diagram showing a second embodiment of a line relating an evaporator in defrost to a main refrigeration line.
Figure 6A:
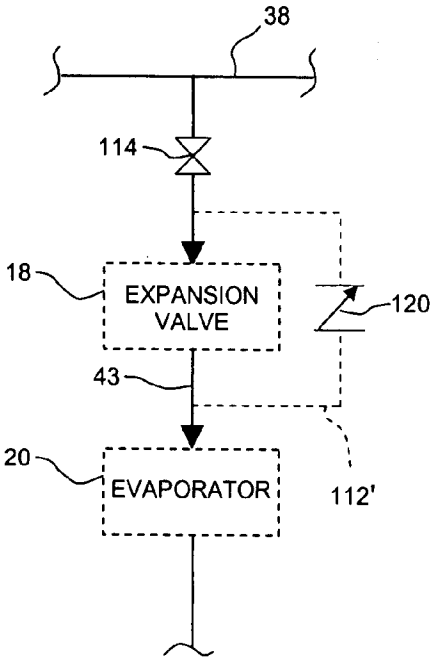
FIG. 6A is an enlarged block diagram showing a first embodiment of a line relating an evaporator in defrost to a main refrigeration line.

It is also contemplated to operate defrost systems without the valve 114, as shown in FIG. 6C. More specifically, the valve 202 maintains the cooling refrigerant pressure lower than the pressure of the defrost refrigerant, so as to enable the mixing of both refrigerants.

Accordingly, the pressure is greater downstream of the expansion valve 18 in defrost than upstream. The defrost refrigerant pressure therefore prevents circulation of cooling refrigerant through the expansion valve 18 associated with an evaporator 20 being defrosted.

Figure 3:
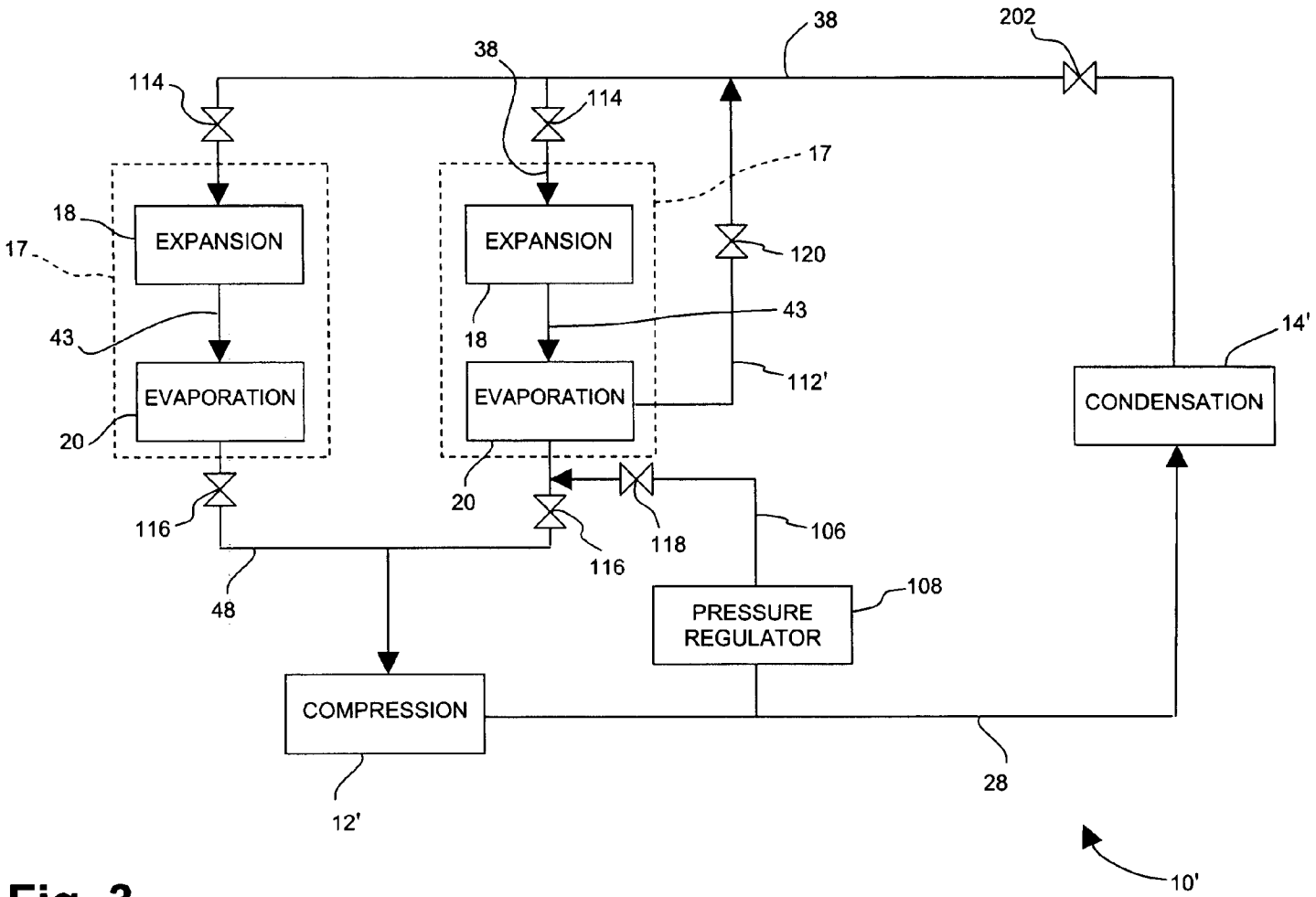
FIG. 3 is a block diagram showing a simplified refrigeration system constructed in accordance with a second embodiment of the present invention.

Referring to FIG. 3, a refrigeration system in accordance with another embodiment of the present invention is generally shown at 10'. The refrigeration system 10' is generally similar to the refrigeration system 10 of FIGS. 1 and 2, and like reference numerals are therefore used to identify like elements.

In the refrigeration system 10' of FIG. 3, the compressions stage 12' does not have any dedicated compressor outputting lower pressure refrigerant to feed evaporators in defrost. Instead, a pressure regulator 108 is provided in the line 106, so as to lower a pressure of the cooling refrigerant, so as to produce defrost refrigerant of suitable lower pressure. It is pointed out that the refrigeration system 10' of FIG. 3 has been simplified for simplicity purposes. For instance, the condensation stage has simply been illustrated as 14', but typically includes condenser units and/or heat reclaim units.

In the refrigeration system 10' of FIG. 1, the defrost of evaporators 20 is operated as follows. One of the evaporators 20 is supplied with refrigerant discharged from the compressor stage 12 by the line 106 having the pressure regulator 108 therein. The pressure regulator 108 creates a pressure differential in the line 106, such that the high-pressure gas refrigerant (cooling refrigerant), typically around 200 Psi, is reduced to a low-pressure gas refrigerant thereafter (defrost refrigerant), for instance at about 110 Psi. The pressure regulator 108 may include a modulating valve in line 106. In the event that the pressure in the evaporator 20 is lower than that of the refrigerant conveyed thereto by the line 106 in a defrost cycle, the modulating valve portion of the pressure regulator 108 will preclude the formation of water hammer by gradually increasing the pressure in the evaporator 20. This feature of the pressure regulator 108 will allow the refrigeration system 10 to feed the evaporators 20 with high-pressure refrigerant, although it is preferred to defrost the evaporators 20 with low-pressure refrigerant. On the other hand, the modulating action can be effected by the valves 118.

Once the evaporator 20 has been defrosted with the defrost refrigerant, the defrost refrigerant is directed to the line 38, thereby mixing with cooling refrigerant, for subsequently being fed to evaporator units 17 in defrost, as was described previously for the refrigeration system 10 of FIGS. 1 and 2.

Figure 4:
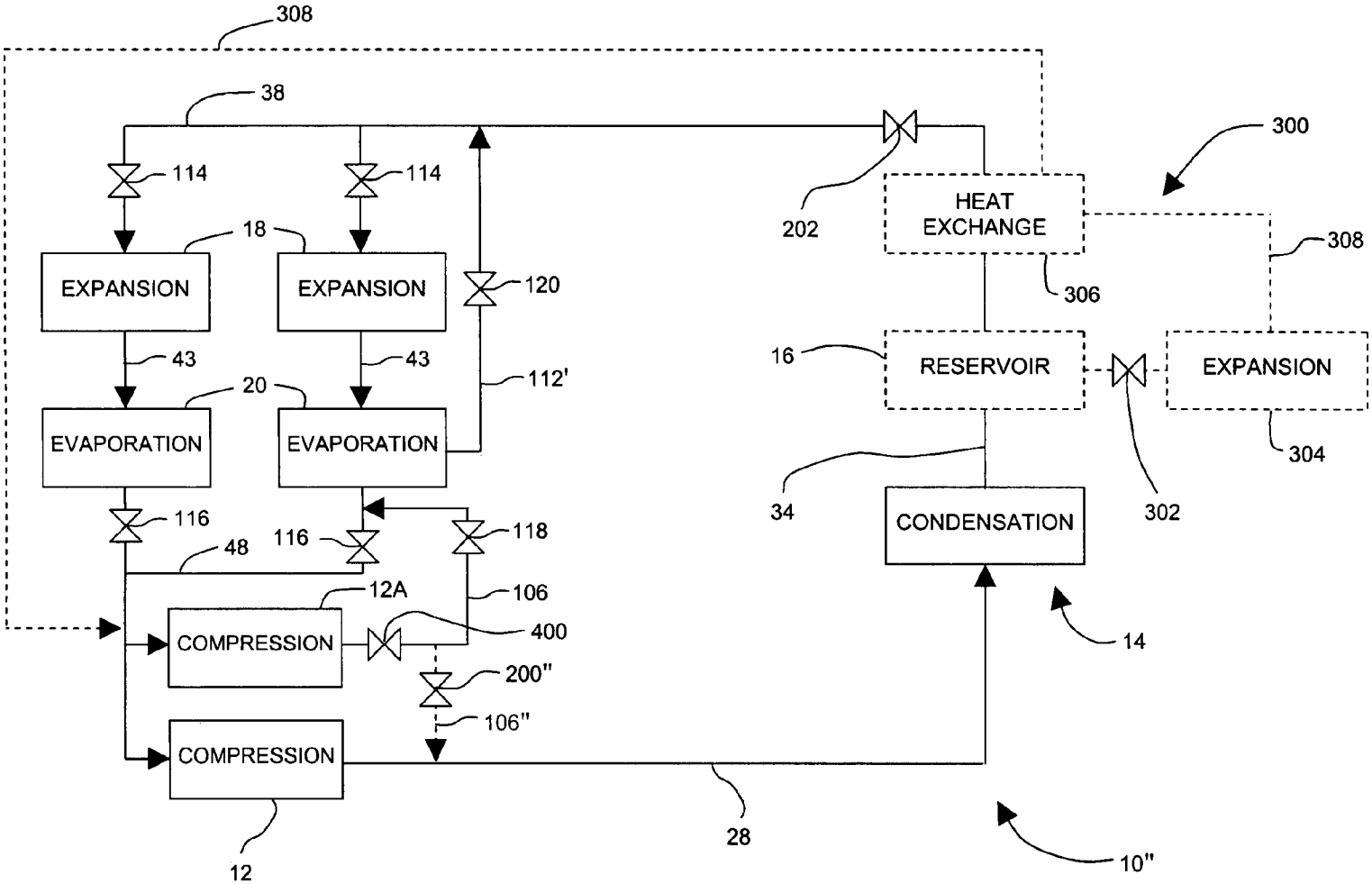
FIG. 4 is a block diagram of the refrigeration system of FIG. 1, with additional sub-cooling features.

Referring to FIG. 4, a refrigeration system 10" is shown that is essentially the refrigeration system 10 of FIG. 1, with alternative components, and with a sub-cooling loop 300. In FIG. 4, a valve 200" (e.g., a check valve or other two-way valve) is provided so as to enable refrigerant from the compressor 12A to reach the line 28. Also, no suction header, such as the suction header 204 of FIG. 1, is provided in the refrigeration system 10" of FIG. 4. These are simple variations of refrigeration systems, provided for illustrative purposes.

The sub-cooling system 300 is provided so as to reduce the amount of flash gas that is fed to the evaporators 20 in the refrigeration cycle. More specifically, due to the mixture of defrost refrigerant with cooling refrigerant for injection in the evaporators 20 in the evaporation stage, it is possible that some flash gas is present in the mixture of refrigerants. Therefore, the sub-cooling system 300 is provided so as to liquefy the cooling refrigerant prior to being mixed with the defrost refrigerant. Various sub-cooling systems may be used, and the sub-cooling system 300 is provided as two separate examples.

Referring to FIG. 4, the sub-cooling system 300 has a line 308 that extends from the reservoir 16. The sub-cooling refrigerant directed in the line 308 is expanded by expansion stage 304 such that its pressure is reduced. The sub-cooling refrigerant is then put in heat-exchange with the cooling refrigerant in heat-exchange stage 306, so as to absorb heat from the cooling refrigerant and thus liquefy the cooling refrigerant, for its subsequent mixture with the defrost refrigerant. The sub-cooling refrigerant is then fed to the compression stage 12.

Also in FIG. 4, a valve 400 is shown at the outlet of the dedicated compressor 12A. The valve 400 is provided so as to ensure that the line 106 at the outlet of the compressor 12A maintains sufficient refrigerant pressure.

Figure 5C:
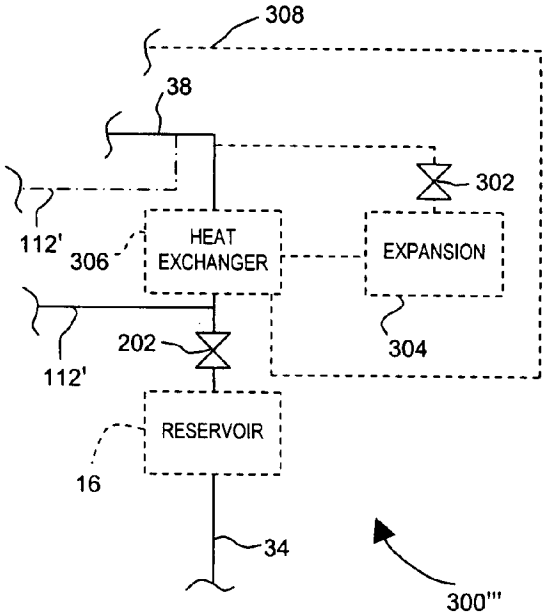
FIG. 5C is an enlarged block diagram showing third and fourth alternative sub-cooling systems.
Figure 5B:
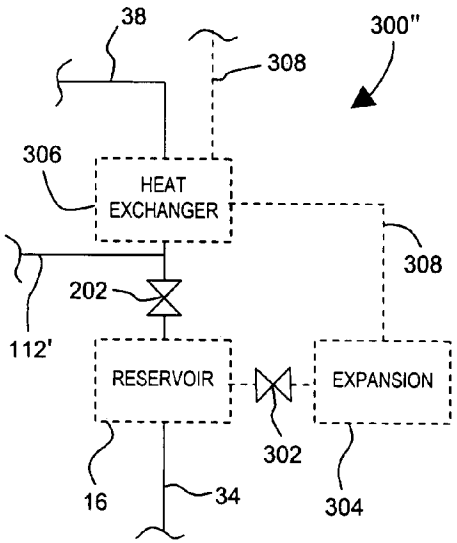
FIG. 5B is an enlarged block diagram showing a second alternative sub-cooling system.
Figure 5A:
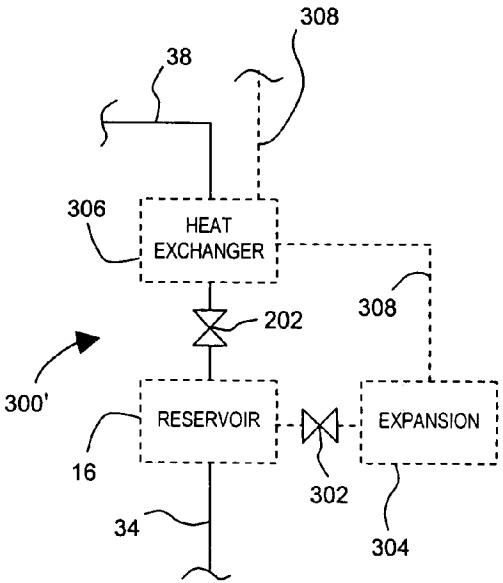
FIG. 5A is an enlarged block diagram showing an alternative sub-cooling system.

In FIG. 5A, a sub-cooling system 300' is similar to the sub-cooling system 300 of FIG. 5A, but with the valve 202 positioned upstream of the heat exchanger 306. In FIG. 5B, a sub-cooling system 300" has the line 112' mixing the defrost refrigerant to the cooling refrigerant upstream of the heat exchanger 306. In FIG. 5C, a sub-cooling system 300'" collects sub-cooling refrigerant downstream of the heat exchanger 306. It is pointed out that line 112' can mix defrost refrigerant to the cooling refrigerant downstream or upstream of the heat exchanger 306, as is illustrated. Other sub-cooling configurations are also possible.

It is obvious that the control of valve operation is preferably fully automated. The valve operation for controlling the defrost of evaporators 20, namely the control of valves 114, 116, 118 and 120, is fully automated.

The defrosting of one of the evaporators 20 can be stopped according to a time delay. More precisely, a defrost cycle of an evaporator 20 can be initiated periodically and have its duration predetermined. For instance, a typical defrost portion of a defrost cycle can last 8 minutes for low pressures of refrigerant fed to the evaporators 20 and can be even shorter for higher pressures. Thereafter, a period is required to have the defrosted evaporator 20 returned to its normal refrigeration operating temperature, and such a period is typically up to 7 minutes in duration. It is also possible to have a sensor positioned downstream of the evaporator 20 in a defrost cycle, that will control the duration of the defrost cycle of a respective evaporator 20 by monitoring the temperature of the refrigerant having defrosted the respective evaporator 20. A predetermined low refrigerant temperature detected by the sensor could trigger an actuation of the valves 114, 116, 118 and 120, to switch the respective evaporator 20 to a refrigeration cycle 20.

It is obvious that the various components enabling the defrost cycle can be regrouped in a pack so as to be provided on site as a defrost system ready to operate. This can simplify the installation of the defrost system to an existing refrigeration system, as the major step in the installation would be to connect the various lines to the defrost system.

Although the refrigeration system 10 of the present invention enables the defrosting of the evaporators 20 at high pressure, it is preferable that the pressure regulator 108 or dedicated compressor 12A reduce the pressure of the refrigerant fed to the evaporators 20 in defrost cycles. In such a case, less refrigerant is required to defrost an evaporator, whereby a plurality of evaporators 20 can be defrosted simultaneously. Moreover, the use of high-pressure refrigerant causes non-negligible thermal expansion of the refrigerant lines. This may result in damages to the lines, as well as rupture of insulating sleeves provided on the refrigerant lines. Accordingly, in an embodiment of the present invention, the refrigeration systems of FIGS. 1 to 5 overcome this disadvantage by using defrost refrigerant of a pressure that is closer to the pressure of the cooling refrigerant.

It is within the ambit of the present invention to cover any obvious modifications of the embodiments described herein, provided such modifications fall within the scope of the appended claims.

The invention claimed is:

1. A defrost refrigeration system of the type having a main refrigeration circuit operating a refrigeration cycle, wherein a refrigerant goes through at least a compressing stage having at least a first and a second compressor, wherein said refrigerant is compressed to a high-pressure gas state to then reach a condensing stage, wherein said refrigerant in said high-pressure gas state is condensed at least partially to a high-pressure liquid state to then reach an expansion stage, wherein said refrigerant in said high-pressure liquid state is expanded to a first low-pressure liquid state to then reach an evaporator stage, wherein said refrigerant in said first low-pressure liquid state is evaporated, at least partially to a first low-pressure gas state by absorbing heat, to then return to said compressing stage, said defrost refrigeration system comprising a first line extending from said first compressor to the evaporator stage and adapted to receive all of the discharged refrigerant from said first compressor, a valve for stopping a suction by the compressing stage of said refrigerant in said first low-pressure liquid state in at least one evaporator of the evaporator stage and directing a flow of said discharged refrigerant to release heat to defrost the at least one evaporator and thereby changing phase at least partially to a second low-pressure liquid state, a second line for directing all of said refrigerant having released heat to the expansion stage of the refrigeration cycle, and a pressure reducing device downstream of the condensing stage for adjusting a pressure of the refrigerant in the high-pressure liquid state mixing with said refrigerant having released heat.

2. The defrost refrigeration system according to claim 1, further comprising a pressure reducing device in the first line so as to reduce a pressure of the discharged low-pressure refrigerant prior to defrosting the at least one evaporator.

3. The defrost refrigeration system according to claim 1, wherein all of the refrigerant in the high-pressure gas state discharged by the second compressor is directed to the condensing stage.

4. The defrost refrigeration system in accordance with claim 1, further comprising a sub-cooling system liquefying a mixture of the cooling refrigerant and the defrost refrigerant.

5. The defrost refrigeration system in accordance with claim 1, further comprising a sub-cooling system liquefying the cooling refrigerant prior to being mixed with the defrost refrigerant.

6. A method for defrosting evaporators in a refrigeration system of the type having a cooling refrigerant circulating sequentially between a compression stage, a condensing stage, an expansion stage and an evaporation stage to then return to the compression stage, comprising:

i) stopping a suction of the cooling refrigerant in a first evaporator of the evaporation stage;

ii) directing defrost refrigerant from the compression stage to the first evaporator so as to defrost the first evaporator;

iii) directing the defrost refrigerant from the first evaporator upstream of the expansion stage; and iv) mixing the cooling refrigerant exiting from the condensing stage with the defrost refrigerant by controlling a cooling refrigerant pressure downstream of the condensing stage; and v) exposing the mixture of cooling refrigerant and defrost refrigerant to a heat exchanger to remove excess gas from the mixture;

vi) directing all of the mixture to the expansion stage;

whereby a second evaporator of the evaporation stage is cooled with the mixture of cooling refrigerant from the condensing stage with the defrost refrigerant.

7. The method according to claim 6, wherein the defrost refrigerant in step ii) is compressed to a reduced pressure by a dedicated compressor.

8. The method according to claim 6, wherein step ii) comprises converting a portion of the cooling refrigerant into the defrost refrigerant by reducing a pressure of the portion of the cooling refrigerant exiting the compression stage.

9. The method according to claim 6, further comprising a step of liquefying the cooling refrigerant prior to step iv).

10. A method for installing a defrost system in a refrigeration system of the type having a cooling refrigerant circulating sequentially during a refrigeration cycle between a compression stage, a condensing stage, an expansion stage and an evaporation stage to then return to the compression stage, comprising:

providing a valve to stop a suction of cooling refrigerant in at least a first evaporator of the evaporation stage;

positioning a first line feeding the first evaporator with defrost refrigerant from the compression stage in a defrost cycle;

positioning a second line between the first evaporator and a main line between the condensing stage and the expansion stage to direct the defrost refrigerant from the first evaporator to the main line to feed at least a second evaporator in the refrigeration cycle;

providing a pressure reducing device in the main line to reduce the pressure of the cooling refrigerant for a subsequent mixing with the defrost refrigerant from the second line in the refrigeration cycle; and providing a sub-cooling system f or liquefying all of the mixture of cooling refrigerant and defrost refrigerant.

11. The method according to claim 10, further comprising a step of providing a pressure reducing configuration so as to convert the cooling refrigerant fed to the first evaporator into a defrost refrigerant of a given reduced pressure.

12. The method according to claim 11, wherein the pressure reducing configuration has a pressure regulator in the first line.

13. The method according to claim 11, wherein the pressure reducing configuration has a compressor directly connected to the first line such that an output of the compressor is below an output of other compressors of the compression stage.

14. The method according to claim 10, further comprising a step of providing a sub-cooling system for liquefying the cooling refrigerant prior to mixing the cooling refrigerant with the defrost refrigerant in the main line.

* * * * *